US008829377B2

(12) United States Patent
Khor

(10) Patent No.: US 8,829,377 B2
(45) Date of Patent: Sep. 9, 2014

(54) SCISSORS-TYPE CONNECTING MEMBER

(71) Applicant: Primax Electronics Ltd., Taipei (TW)

(72) Inventor: Chin-Siong Khor, Taipei (TW)

(73) Assignee: Primax Electronics Ltd., Taipei (TW)

( * ) Notice: Subject to any disclaimer, the term of this patent is extended or adjusted under 35 U.S.C. 154(b) by 60 days.

(21) Appl. No.: 13/670,206

(22) Filed: Nov. 6, 2012

(65) Prior Publication Data

US 2014/0124345 A1 May 8, 2014

(51) Int. Cl.
*H01H 13/70* (2006.01)

(52) U.S. Cl.
USPC ..... 200/344

(58) Field of Classification Search
USPC ..... 200/314, 5 R, 5 A, 46, 510–514, 520, 200/521, 308, 310, 311, 312, 313, 318.1, 200/337, 341, 343, 344, 345
See application file for complete search history.

(56) References Cited

U.S. PATENT DOCUMENTS 6,091,036 A * 7/2000 Hu ..... 200/344
6,706,986 B2 * 3/2004 Hsu ..... 200/344
7,385,149 B2 * 6/2008 Liu ..... 200/5 A

* cited by examiner

*Primary Examiner* — Renee Luebke
*Assistant Examiner* — Anthony R. Jimenez
(74) *Attorney, Agent, or Firm* — Kirton McConkie; Evan R. Witt

(57) ABSTRACT

A scissors-type connecting member includes an inner frame and an outer frame. The inner frame includes a pivot rod. The pivot rod includes a curved edge and two flat slant surfaces. The outer frame includes a pivot hole, an entrance, and a guiding surface. The pivot hole has a flat bottom surface. The entrance is located beside the pivot hole. The guiding surface is disposed under the entrance. For assembling the scissors-type connecting member, the pivot rod of the inner frame is moved into the pivot hole along the guiding surface. When the inner frame is rotated relative to the outer frame, the two flat slant surfaces of the pivot rod are respectively stopped by the bottom surface of the pivot hole and the guiding surface. Consequently, a rotating angle of the inner frame relative to the outer frame is limited.

5 Claims, 5 Drawing Sheets

SCISSORS-TYPE CONNECTING MEMBER

FIELD OF THE INVENTION

The present invention relates to a scissors-type connecting member, and more particularly to a scissors-type connecting member for a key structure of a keyboard.

BACKGROUND OF THE INVENTION

Nowadays, consumer electronic products have experienced great growth and are now rapidly gaining in popularity. Especially, notebook computers have become dispensable electronic products of the office workers.

The notebook computer comprises a keyboard with plural key structures. Generally, a key structure of the keyboard of the notebook computer mainly comprises a scissors-type connecting member, an elastic element, and a keycap. The elastic element is disposed within the scissors-type connecting member. The keycap is disposed over the scissors-type connecting member and the elastic element. Typically, the scissors-type connecting member comprises an inner frame and an outer frame. Hereinafter, the configurations of a conventional scissors-type connecting member will be illustrated with reference to FIGS. 1, 2 and 3. FIG. 1 is a schematic perspective view illustrating a conventional scissors-type connecting member. FIG. 2 is a schematic perspective view illustrating an outer frame of the conventional scissors-type connecting member of FIG. 1. FIG. 3 is a schematic perspective view illustrating an inner frame of the conventional scissors-type connecting member of FIG. 1.

As shown in FIGS. 1, 2 and 3, the scissors-type connecting member 1 comprises an inner frame 11 and an outer frame 12. A circular pivot hole 121 is formed in an inner surface of the outer frame 12. A pivot rod 111 is protruded from an outer surface of the inner frame 11. For assembling the scissors-type connecting member 1, the pivot rod 111 of the inner frame 11 is inserted into the pivot hole 121 of the outer frame 12, so that the inner frame 11 is pivotally coupled to the outer frame 12.

The conventional scissors-type connecting member 1, however, still has some drawbacks. For example, the inner frame 11 and the outer frame 12 are pivotally coupled to each other through the pivot rod 111. Since the scissors-type connecting member 1 is not equipped with a position-limiting structure, the inner frame 11 may be rotated relative to the outer frame 12 at any rotating angle. The absence of the position-limiting structure is detrimental to the connection between the keycap and the scissors-type connecting member 1. That is, the scissors-type connecting member 1 is readily connected with the keycap in a wrong direction.

Moreover, the inner frame 11 and the outer frame 12 of the conventional scissors-type connecting member 1 fail to be directly combined together. That is, for combining the inner frame 11 with the outer frame 12, the outer frame 12 should be manually widened and subjected to a tiny deformation. After the outer frame 12 is widened, the pivot rod 111 of the inner frame 11 can be inserted into the pivot hole 121 of the outer frame 12. Under this circumstance, since the assembling time is increased, the throughput of the keyboard is reduced. Moreover, it is unable to automatically assemble the scissors-type connecting member 1.

Therefore, there is a need of providing an improved scissors-type connecting member in order to eliminate the above drawbacks.

SUMMARY OF THE INVENTION

The present invention provides a scissors-type connecting member. The scissors-type connecting member can be assembled quickly and automatically. Moreover, in the scissors-type connecting member of the present invention, the rotating angle of the inner frame relative to the outer frame can be limited.

In accordance with an aspect of the present invention, there is provided a scissors-type connecting member. The scissors-type connecting member includes an inner frame and an outer frame. The inner frame includes a pivot rod. The outer frame includes a mounting part, wherein the mounting part includes an entrance and a pivot hole. After the pivot rod of the inner frame is introduced into the pivot hole through the entrance, the inner frame is pivotally coupled to the outer frame, and the pivot rod and the pivot hole interfered with each other to limit a rotating angle of the inner frame relative to the outer frame.

In an embodiment, the outer frame further includes an outer frame body, wherein the mounting part is disposed on an inner surface of the outer frame body.

In an embodiment, the mounting part further includes a guiding surface, which is extended downwardly from a first side of the entrance and located beside the pivot hole. A bottom surface of the pivot hole is a flat surface. A top surface of the pivot hole is a curved surface. The bottom surface of the pivot hole is connected with the guiding surface.

In an embodiment, the inner frame further includes an inner frame body. The pivot rod is disposed on an outer surface of the inner frame body. The pivot rod includes a curved edge and two flat slant surfaces. The two flat slant surfaces are respectively extended from two opposite sides of the curved edge and symmetrical to each other. After the pivot rod is introduced into the pivot hole, the curved edge is contacted with the top surface of the pivot hole.

In an embodiment, after the pivot rod is introduced into the pivot hole, the two flat slant surfaces of the pivot rod are respectively stopped by the bottom surface of the pivot hole and the guiding surface, so that the bottom surface of the pivot hole and the guiding surface interfere with the two flat slant surfaces to limit the rotating angle of the inner frame relative to the outer frame.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a scissors-type connecting member for a key structure of a keyboard.

Figure 1:
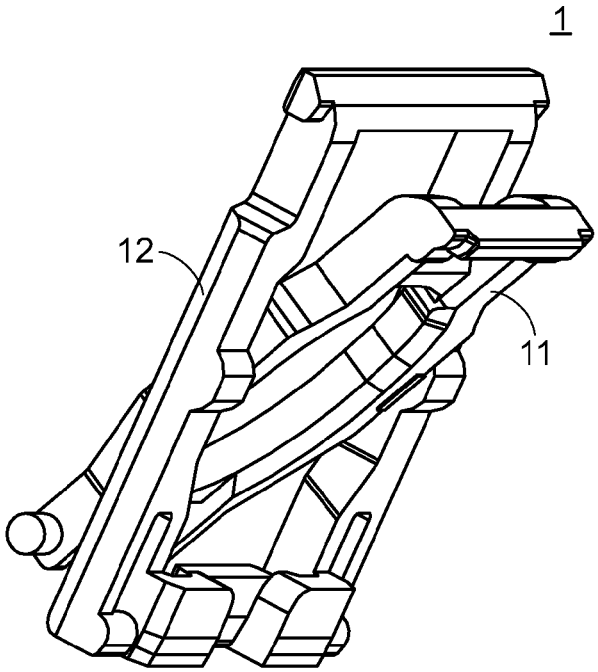
FIG.1 PRIOR ART
FIG. 1 is a schematic perspective view illustrating a conventional scissors-type connecting member.
Figure 2:
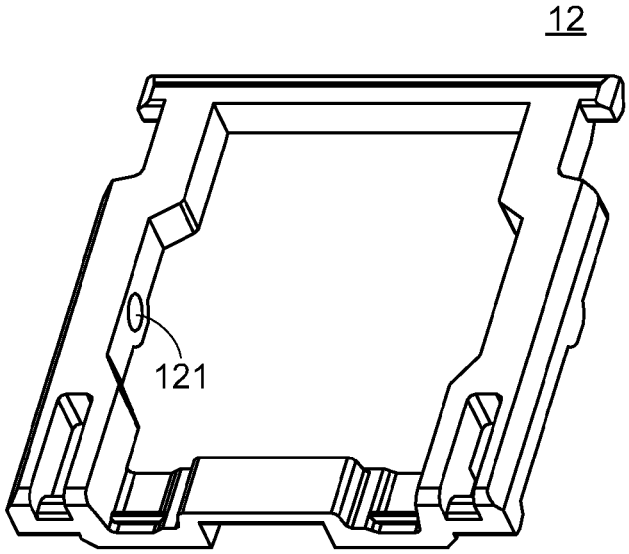
FIG.2 PRIOR ART
FIG. 2 is a schematic perspective view illustrating an outer frame of the conventional scissors-type connecting member of FIG. 1.
Figure 3:
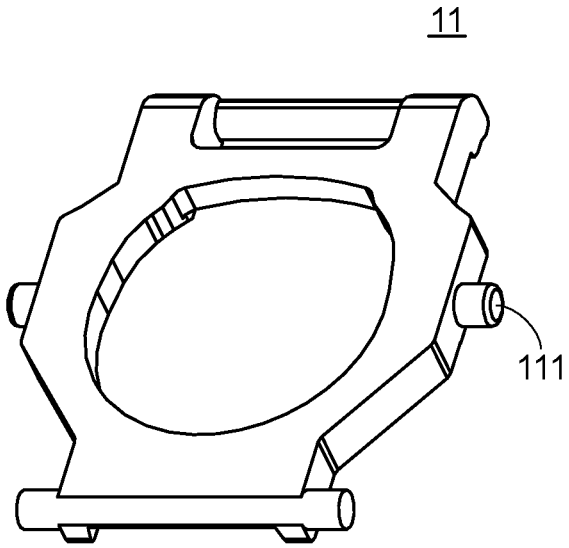
FIG.3 PRIOR ART
FIG. 3 is a schematic perspective view illustrating an inner frame of the conventional scissors-type connecting member of FIG. 1.
Figure 4:
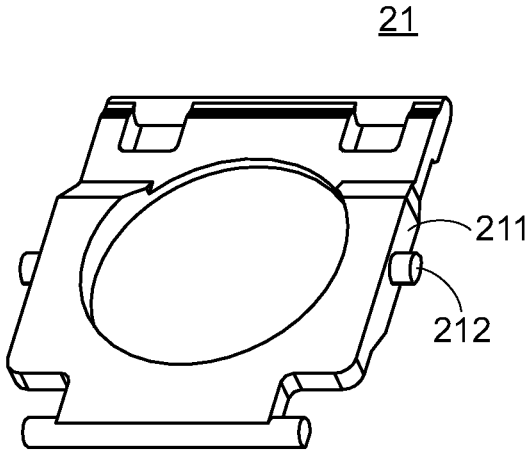
FIG. 4 is a schematic perspective view illustrating an inner frame of a scissors-type connecting member according to an embodiment of the present invention.
Figure 5:
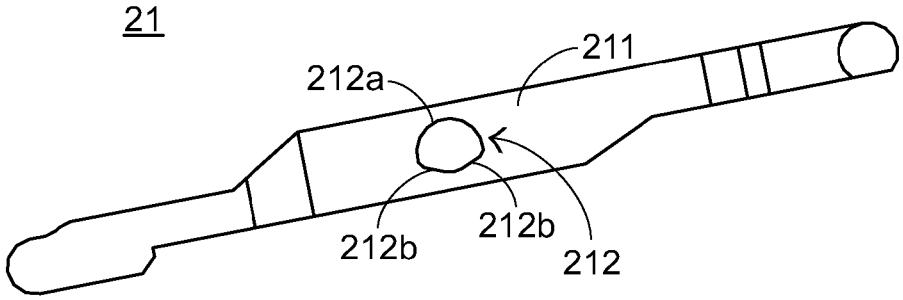
FIG. 5 is a schematic side view illustrating the inner frame of the scissors-type connecting member of FIG. 4.
Figure 6:
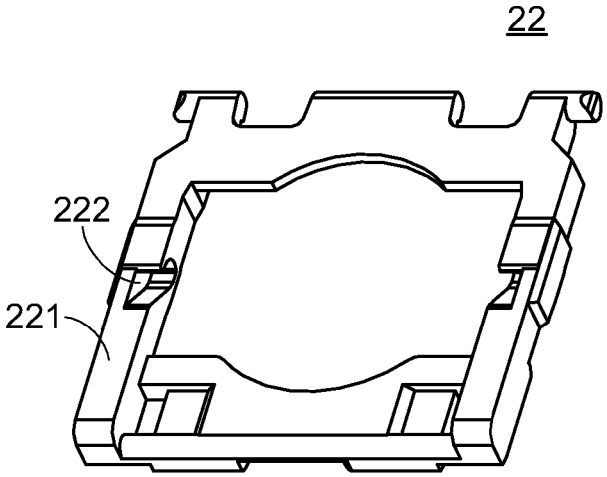
FIG. 6 is a schematic perspective view illustrating an outer frame of the scissors-type connecting member according to the embodiment of the present invention.
Figure 7:
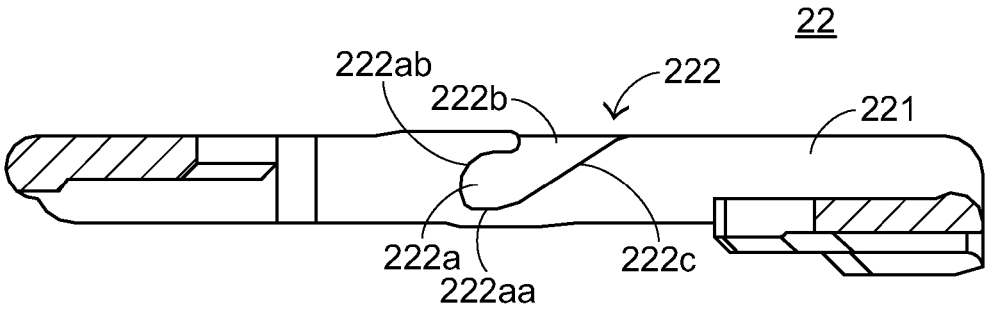
FIG. 7 is a schematic section view illustrating the outer frame of the scissors-type connecting member of FIG. 6.

Hereinafter, the configurations of a scissors-type connecting member of the present invention will be illustrated with reference to FIGS. 4-7. FIG. 4 is a schematic perspective view illustrating an inner frame of a scissors-type connecting member according to an embodiment of the present invention. FIG. 5 is a schematic side view illustrating the inner frame of the scissors-type connecting member of FIG. 4. FIG. 6 is a schematic perspective view illustrating an outer frame of the scissors-type connecting member according to the embodiment of the present invention. FIG. 7 is a schematic section view illustrating the outer frame of the scissors-type connecting member of FIG. 6.

First of all, the components of the scissors-type connecting member will be illustrated. The scissors-type connecting member 2 comprises an inner frame 21 and an outer frame 22.

As shown in FIGS. 4 and 5, the inner frame 21 comprises an inner frame body 211 and a pivot rod 212. The pivot rod 212 is protruded from an outer surface of the inner frame body 211. The pivot rod 212 comprises a curved edge 212*a* and two flat slant surfaces 212*b*. The two flat slant surfaces 212*b* are extended from two opposite sides of the curved edge 212*a*, respectively. Moreover, the two flat slant surfaces 212*b* intersect with each other. In addition, the two flat slant surfaces 212*b* are symmetrical to each other.

As shown in FIGS. 6 and 7, the outer frame 22 comprises an outer frame body 221 and a mounting part 222. The mounting part 222 is disposed on an inner surface of the outer frame body 221. In addition, the mounting part 222 comprises a pivot hole 222*a*, an entrance 222*b*, and a guiding surface 222*c*.

In particular, a bottom surface 222*aa* of the pivot hole 222*a* is a flat surface, and a top surface 222*ab* of the pivot hole 222*a* is a curved surface. The guiding surface 222*c* is disposed under the entrance 222*b*, and located beside the pivot hole 222*a*. In addition, the guiding surface 222*c* is extended downwardly from a first side of the entrance 222*b*, and connected with the bottom surface 222*aa* of the pivot hole 222*a*.

Figure 8:
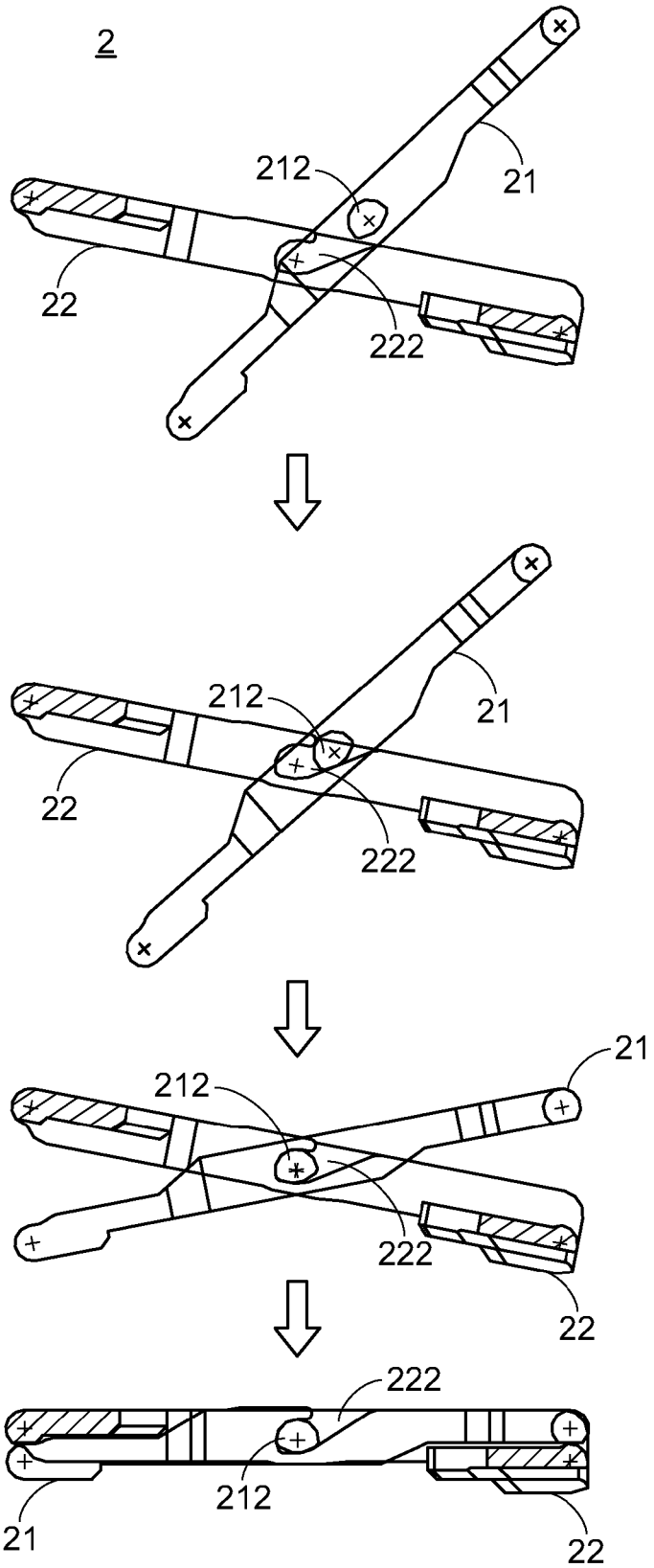
FIG. 8 schematically illustrates a process of assembling the scissors-type connecting member according to the embodiment of the present invention.
Figure 9:
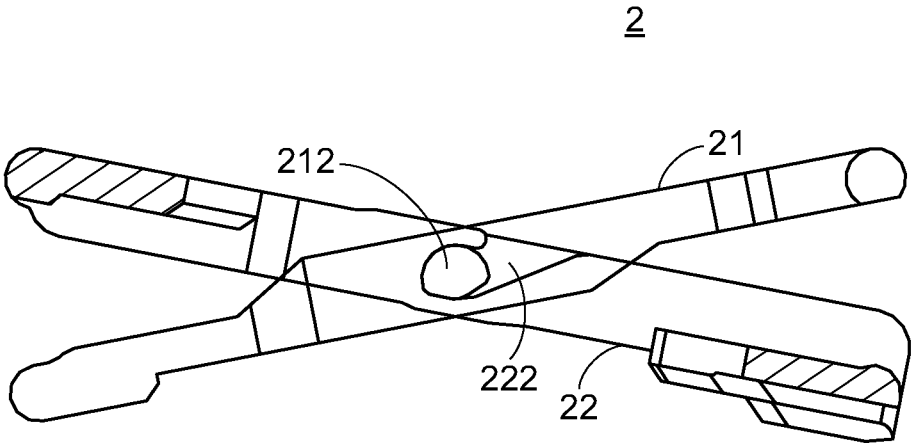
FIG. 9 is a schematic assembled view illustrating the scissors-type connecting member according to the embodiment of the present invention.

Hereinafter, a sequence of assembling the scissors-type connecting member 2 of the present invention will be illustrated with reference to FIGS. 4-9. FIG. 8 schematically illustrates a process of assembling the scissors-type connecting member according to the embodiment of the present invention. FIG. 9 is a schematic assembled view illustrating the scissors-type connecting member according to the embodiment of the present invention.

For assembling the scissors-type connecting member 2, the pivot rod 212 of the inner frame 21 is firstly transferred through the entrance 222*b* of the outer frame 22 and then introduced into the pivot hole 222*a*, so that the inner frame 21 is pivotally coupled to the inner surface of the outer frame 22. The assembling process will be illustrated in more details as follows.

Firstly, the curved edge 212*a* of the pivot rod 212 and one of the two flat slant surfaces 212*b* are transferred through the entrance 222*b*. At the same time, the flat slant surface 212*b* is contacted with the guiding surface 222*c* under the entrance 222*b*, and the curved edge 212*a* is contacted with a second side of the entrance 222*b*. The flat slant surface 212*b* of the pivot rod 212 is continuously moved into the pivot hole 222*a* along the guiding surface 222*c*, and then contacted with the bottom surface 222*aa* of the pivot hole 222*a*. Meanwhile, the curved edge 212*a* is also contacted with the top surface 222*ab* of the pivot hole 222*a*.

Under this circumstance, the inner frame 21 is pivotally coupled to the inner surface of the outer frame 22, and the inner frame 21 is rotatable relative to the outer frame 22.

Moreover, during the process of combining the inner frame 21 with the outer frame 22, in response to a downward force exerted on the inner frame 21, the second side of the entrance 222*b* is pushed by the curved edge 212*a*. Consequently, the second side of the entrance 222*b* is subjected to a tiny deformation. Due to the tiny deformation, the pivot rod 212 can be introduced into the pivot hole 222*a*.

After the pivot rod 212 is introduced into the pivot hole 222*a*, the inner frame 21 is rotatable relative to the outer frame 22. As the inner frame 21 is rotated, the two flat slant surfaces 212*b* of the pivot rod 212 are respectively stopped by the bottom surface 222*aa* of the pivot hole 222*a* and the guiding surface 222*c* beside the pivot hole 222*a*, and the curved edge 212*a* is continuously contacted with the top surface 222*ab* of the pivot hole 222*a*. Since the bottom surface 222*aa* of the pivot hole 222*a* and the guiding surface 222*c* beside the pivot hole 222*a* interfere with the two flat slant surfaces 212*b*, the rotating angle of the inner frame 21 relative to the outer frame 22 is limited.

From the above descriptions, the present invention provides a scissors-type connecting member. In the scissors-type connecting member 2 of the present invention, the entrance 222*b* is located beside the pivot hole 222*a*, and the inclined guiding surface 222*c* is disposed under the entrance 222*b*. Consequently, during the process of assembling the scissors-type connecting member 2, the pivot rod 212 of the inner frame 21 can be easily inserted into the pivot hole 222*a* of the outer frame 22.

Moreover, since the bottom surface 222*aa* of the pivot hole 222*a* and the guiding surface 222*c* beside the pivot hole 222*a* interfere with the two flat slant surfaces 212*b*, the inner frame 21 is only rotatable relative to the outer frame 22 in a single direction at a limited rotating angle.

In comparison with the conventional scissors-type connecting member, the inner frame of the scissors-type connecting member of the present invention can be quickly installed on the outer frame. Consequently, the scissors-type connecting member of the present invention can be assembly automatically. Moreover, the rotating angle of the inner frame relative to the outer frame is limited. Consequently, during the process of assembling a key structure, the scissors-type connecting member and the cap are combined with each other in only a specified direction. Under this circumstance, the overall working efficiency is enhanced, and the possibility of erroneously assembling the key structure is largely reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A scissors-type connecting member, comprising:

an outer frame comprising a mounting part, wherein said mounting part comprises an entrance and a pivot hole; and an inner frame comprising a pivot rod to be pivotally coupled to said mounting part, said pivot rod having a cross section configured by a curve section and two linear sections, wherein one of said two linear sections is used for leading said coupling portion of said pivot rod into said pivot hole from said entrance, said curve section is pivotal inside said pivot hole, and another one of said two linear sections interferes with an inner surface of said mounting part for stopping said curve section from rotating beyond a specified range in said pivot hole so as to limit a rotating angle of said inner frame relative to said outer frame.

2. The scissors-type connecting member according to claim 1, wherein said outer frame further comprises an outer frame body, wherein said mounting part is disposed on an inner surface of said outer frame body.

3. The scissors-type connecting member according to claim 1, wherein said mounting part further comprises a guiding surface, which is extended downwardly from a first side of said entrance and located beside said pivot hole for guiding said one of said two linear sections to lead said pivot rod to enter said pivot hole, wherein a bottom surface of said pivot hole is a flat surface on which said one of said two linear sections rests, and a top surface of said pivot hole is a curved surface on which said curve section of said pivot rod is rotatable, and wherein said bottom surface of said pivot hole continuously extends from said guiding surface and said another one of said two linear sections interferes with said guiding surface for stopping said curve section from rotating beyond said specified range in a first direction.

4. The scissors-type connecting member according to claim 3, wherein said inner frame further comprises an inner frame body, and said pivot rod is disposed on an outer surface of said inner frame body, wherein said two linear sections extend from two opposite sides of said curve section and symmetrical to each other.

5. The scissors-type connecting member according to claim 4, wherein said one of said two linear sections interferes with said guiding surface for stopping said curve section from rotating beyond said specified range in a second direction opposite to said first direction.

* * * * *